US006693654B2

(12) United States Patent
Shinohara

(10) Patent No.: US 6,693,654 B2
(45) Date of Patent: Feb. 17, 2004

(54) COLOR IMAGE FORMATION APPARATUS AND METHOD INCLUDING THREE ALIGNMENT SENSORS AND DENSITY ADJUSTMENT SENSOR

(75) Inventor: Tadashi Shinohara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/243,933

(22) Filed: Sep. 16, 2002

(65) Prior Publication Data

US 2003/0052958 A1 Mar. 20, 2003

(30) Foreign Application Priority Data

Sep. 14, 2001 (JP) ..... 2001-279354

(51) Int. Cl.[7] ..... G03G 15/01; G03G 15/00
(52) U.S. Cl. ..... 347/116; 399/49; 399/301
(58) Field of Search ..... 347/116, 234; 399/49, 299, 301, 101

(56) References Cited

U.S. PATENT DOCUMENTS

| | | | |
|---|---|---|---|
| 5,621,221 | A | 4/1997 | Shinohara et al. |
| 5,737,665 | A | 4/1998 | Sugiyama et al. |
| 5,765,083 | A | 6/1998 | Shinohara |
| 5,875,380 | A | 2/1999 | Iwata et al. |
| 5,899,597 | A | 5/1999 | Shinohara et al. |
| 5,962,783 | A | 10/1999 | Iwata et al. |
| 5,963,240 | A | 10/1999 | Shinohara et al. |
| 6,118,557 | A | 9/2000 | Sugiyama et al. |
| 6,128,459 | A | 10/2000 | Iwata et al. |
| 6,282,396 | B1 | 8/2001 | Iwata et al. |
| 6,295,435 | B1 | 9/2001 | Shinohara et al. |
| 6,380,960 | B1 | 4/2002 | Shinohara |
| 6,381,435 | B2 | 4/2002 | Shinohara et al. |

FOREIGN PATENT DOCUMENTS

| | | | |
|---|---|---|---|
| EP | 0 319 241 A2 | | 6/1989 |
| JP | 2002-14505 A | * | 1/2001 |
| JP | 2001-34028 A | * | 2/2001 |
| JP | 2001-154425 A | * | 6/2001 |

OTHER PUBLICATIONS

Patent Abstracts of Japan, JP 10–260567, Sep. 29, 1998.
Patent Abstracts of Japan, JP 10–282763, Oct. 23, 1998.

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A color image formation apparatus of this invention includes a density adjustment sensor which detects a density adjustment mark arranged at a position at which a detection area of the density adjustment sensor does not overlap with detection areas of alignment sensors in a direction orthogonal to a moving direction of an endless belt and transferred onto the endless belt. Detection of the alignment mark by the alignment sensors and detection of the density adjustment mark by the density adjustment sensor can be performed in parallel.

9 Claims, 6 Drawing Sheets

COLOR IMAGE FORMATION APPARATUS AND METHOD INCLUDING THREE ALIGNMENT SENSORS AND DENSITY ADJUSTMENT SENSOR

BACKGROUND OF THE INVENTION

1) Field of the Invention

This invention relates to a tandem color image formation apparatus and a tandem color image formation method.

2) Description of the Related Art

Conventionally, tandem color image formation apparatuses each of which has a plurality of image processing sections have been widely spread. One example of the tandem color image formation apparatus of this type will be explained with reference to FIGS. 7 to 10. FIG. 7 is a schematic diagram which shows the overall configuration of a color image formation apparatus. FIG. 8 is a perspective view which shows apart of the color image formation apparatus. FIG. 9 is an explanatory view which shows alignment marks transferred onto a conveyor belt and sensors which detect the marks. FIG. 10 is an explanatory view which shows density adjustment marks transferred onto the conveyor belt and a sensor which detects the marks.

This color image formation apparatus includes four image processing sections 1Y, 1M, 1C and 1K which form images of different colors (yellow Y, magenta M, cyan C and black K) and a conveyor belt 3 which transfers a sheet 2 onto which a formed image is transferred. The conveyor belt 3 is an endless belt which is supported by a driving roller 4 and a driven roller 5 and which is driven to rotate. The four image processing sections 1Y, 1M, 1C and 1K are aligned along the moving direction of this conveyor belt 3.

The four image processing sections 1Y, 1M, 1C and 1K form images of yellow Y, magenta M, cyan C and black K, respectively, and are equal in structure. Therefore, only the image processing section 1Y will be concretely explained hereafter while the other image processing sections 1M, 1C and 1K are shown only in FIG. 7 and FIG. 8 by denoting the constituent elements of the image processing sections 1M, 1C and 1K by reference symbols replacing the corresponding reference symbols for those of the image processing section 1Y.

A paper feed tray 6 which contains sheets 2 is arranged below the conveyor belt 3. In forming an image, the sheets 2 contained in the paper feed tray 6 starting at the uppermost sheet 6 are sequentially fed out and attached to the conveyor belt 3 by electrostatic chucking. The sheets 2 attached to the conveyor belt 3 are transferred to the first image processing section 1Y in which a yellow toner image is transferred onto the sheets 6, respectively.

The image processing section 1Y consists of a photosensitive drum 7Y serving as an image carrier, a charger 8Y disposed around the photosensitive drum 7Y, an exposure device 9, a developer 10Y, a photosensitive cleaner 11Y, a transfer device 12Y and the like. The exposure device 9 is employed by not only the image processing section 1Y but also the other image processing sections 1M, 1C and 1K. A yellow image laser beam LY is applied to the photosensitive drum 7Y, a magenta image laser beam LM is applied to a photosensitive drum 7M, a cyan image laser beam LC is applied to a photosensitive drum 7C and a black image laser beam LK is applied to a photosensitive drum 7K.

Each of the sheets 2 conveyed by the conveyor belt 3 onto which the yellow toner image is transferred, is then subjected to the transfer of a magenta toner image in the image processing section 1M, the transfer of a cyan toner image in the image processing section 1C and the transfer of a black toner image in the image processing section 1K. The sheet 6 onto which these images are transferred is peeled off from the conveyor belt 3, fed into a fixing device 13 in which a toner image fixing processing is conducted to the sheet 6.

Three sensors 14, 15 and 16 which are arranged to face the front surface of the conveyor belt 3 in a direction (main scan direction) orthogonal to the moving direction (sub-scan direction) of the conveyor belt 3, below the conveyor belt 3 and near the driven roller 5. These sensors 14, 15 and 16 are used to detect alignment marks 17 formed by the image processing sections 1Y, 1M, 1C and 1K and transferred onto the conveyor belt 3. Among them, the sensor 14 is used to detect density adjustment marks 18 (see FIG. 10) formed by the image processing sections 1Y, 1M, 1C and 1K and transferred onto the conveyor belt 3.

A belt cleaner 19 which cleans the alignment marks 17 and the density adjustment marks 18 transferred onto the conveyor belt 3, is provided slightly downstream of the sensors 14, 15 and 16 along the moving direction of the conveyor belt 3.

As shown in FIG. 9, the alignment marks 17 are formed at positions opposed to the sensors 14, 15 and 16, respectively, on the conveyor belt 3. Each alignment mark 17 consists of a line mark (lateral line mark) parallel to the main scan direction and a line mark (inclined mark) inclined relative to this lateral line mark. The sensors 14, 15 and 16 read the alignment marks 17, respectively. A control section, not shown, which includes a main CPU performs an arithmetic operation for an image slippage quantity and that for a correction quantity to eliminate the slippage and issues a correction execution instruction for each color based on the read result. It is thereby possible to adjust the following five positional slippages, 1 a sub-scan registration slippage caused by the error of the axial distance among the photosensitive drums 7Y, 7M, 7C and 7K provided in the image processing sections 1Y, 1M, 1C and 1K, respectively, 2 an inclination slippage caused by the uneven inclinations of the photosensitive drums 7Y, 7M, 7C and 7K provided in the image processing sections 1Y, 1M, 1C and 1K, respectively in the main scan direction, 3 a main scan resist slippage caused by the slippage of respective image write positions, 4 a scaling slippage caused by the different lengths of scanning lines for the four colors, respectively, and 5 a scaling error deviation slippage caused by a partial error in the scaling of the main scan direction. If the positional slippages 1 to 4 are to be adjusted, it suffices to employ only the two sensors 14 and 16.

As shown in FIG. 10, the density adjustment marks 18 are formed on positions facing the sensor 14 on the conveyor belt 3 and formed as gradation images by changing densities for the respective colors, respectively. The sensor 14 reads the density adjustment marks 18. The control section, not shown, performs an arithmetic operation for density and that for a correction quantity for the density and issues a correction execution instruction for each color, whereby the density of a resultant image can be optimally controlled.

Conventionally, the density adjustment mark 18 for adjusting the density of the image of each color is detected by the sensor 14 which detects the alignment mark 17 for aligning the images of the respective colors to one another. Concrete procedures for the detection of the alignment marks 17 and the density adjustment marks 18 are as follows.

Alignment marks 17 are first formed, transferred onto the conveyor belt 3, detected by the sensors 14, 15 and 16, respectively, and cleaned by the belt cleaner 19 after being detected. After cleaning, density adjustment marks 18 are formed, transferred onto the conveyor belt 3, detected by the sensor 14 and cleaned by the belt cleaner 19 after being detected.

That is, after the completion of the formation, transfer, detection and cleaning of the alignment marks 17, the formation, transfer, detection and cleaning of the density adjustment marks 18 start. As a result, a lot of time is required until operations for the alignment of the images of the respective colors and the density adjustment thereof are finished, disadvantageously deteriorating work efficiency for image formation.

SUMMARY OF THE INVENTION

It is an object of the present invention to reduce time required for the alignment and density adjustment of images of respective colors and to enhance work efficiency for image formation.

According to one aspect of the present invention, a color image formation apparatus comprises, an endless belt which is driven to rotate, a plurality of image processing sections which are arranged along a moving direction of the endless belt and which form images of different colors, respectively, and a plurality of alignment sensors which are arranged in a direction orthogonal to the moving direction of the endless belt and each of which detects an alignment mark for each color formed by each of the image processing sections and transferred onto the endless belt, wherein the color image formation apparatus comprises a density adjustment sensor which is arranged at a position at which a detection area of the density adjustment sensor does not overlap detection areas of the alignment sensors in the direction orthogonal to the moving direction of the endless belt, and which detects a density adjustment mark transferred onto the endless belt, and wherein densities of the images formed by the image processing sections are adjusted corresponding to a detected result of the density adjustment sensor.

Accordingly, the alignment sensors which detect the alignment marks transferred onto the endless belt and the density adjustment sensor which detects the density adjustment marks transferred onto the endless belt are provided separately from each other. In addition, the alignment sensor and the density adjustment sensor are arranged so that the detection area of the density adjustment sensor does not overlap with those of the alignment sensors in the direction orthogonal to the moving direction of the endless belt. It is, therefore, possible to detect the alignment marks by the alignment sensors and the density adjustment marks by the density adjustment sensor in parallel. It is also possible to reduce time required until the alignment of images of respective colors performed based on detected results for the alignment marks and density adjustment of the images performed based on detected results for the density adjustment marks are finished. It is thereby possible to enhance work efficiency for image formation.

These and other objects, features and advantages of the present invention are specifically set forth in or will become apparent from the following detailed descriptions of the invention when read in conjunction with the accompanying drawings.

DETAILED DESCRIPTIONS

The present inventing relates to a tandem color image formation apparatus which includes an endless belt such as a conveyor belt or an intermediate transfer belt conveying a paper sheet, and a plurality of image processing sections arranged along the moving direction of this endless belt and forming images of different colors, respectively.

Figure 1:
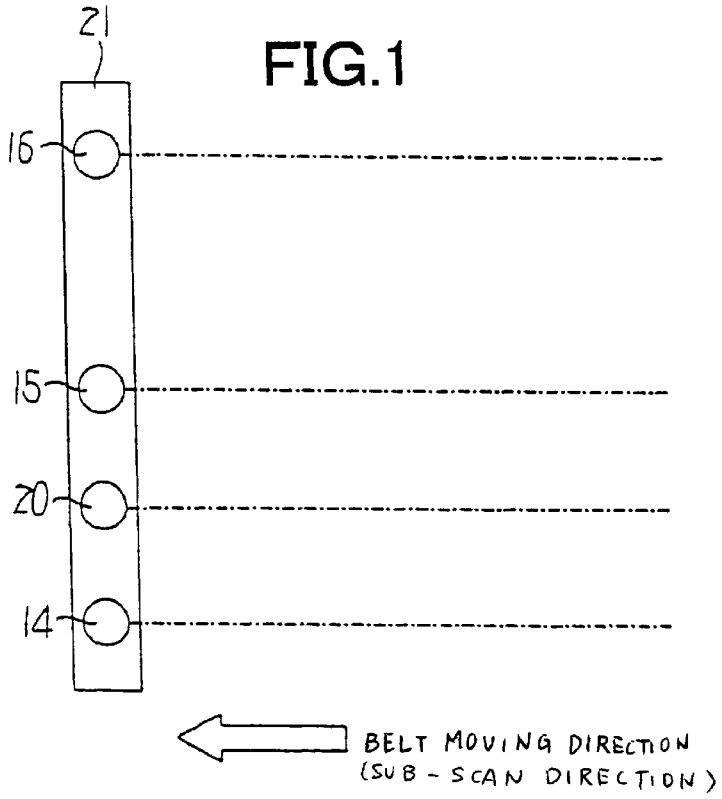
FIG. 1 shows the state of the arrangement of alignment sensors and a density adjustment sensor in a color image formation apparatus in a first embodiment according to the present invention.
Figure 2:
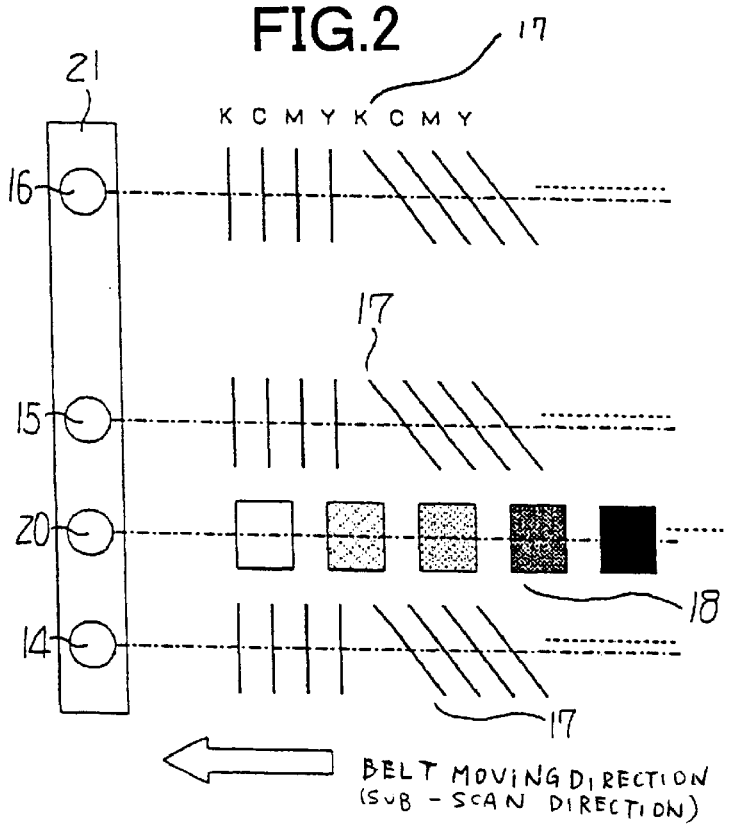
FIG. 2 shows alignment marks and density adjustment marks transferred onto a convey or belt, the alignment sensors and the density adjustment sensor which detect the respective marks.
Figure 3:
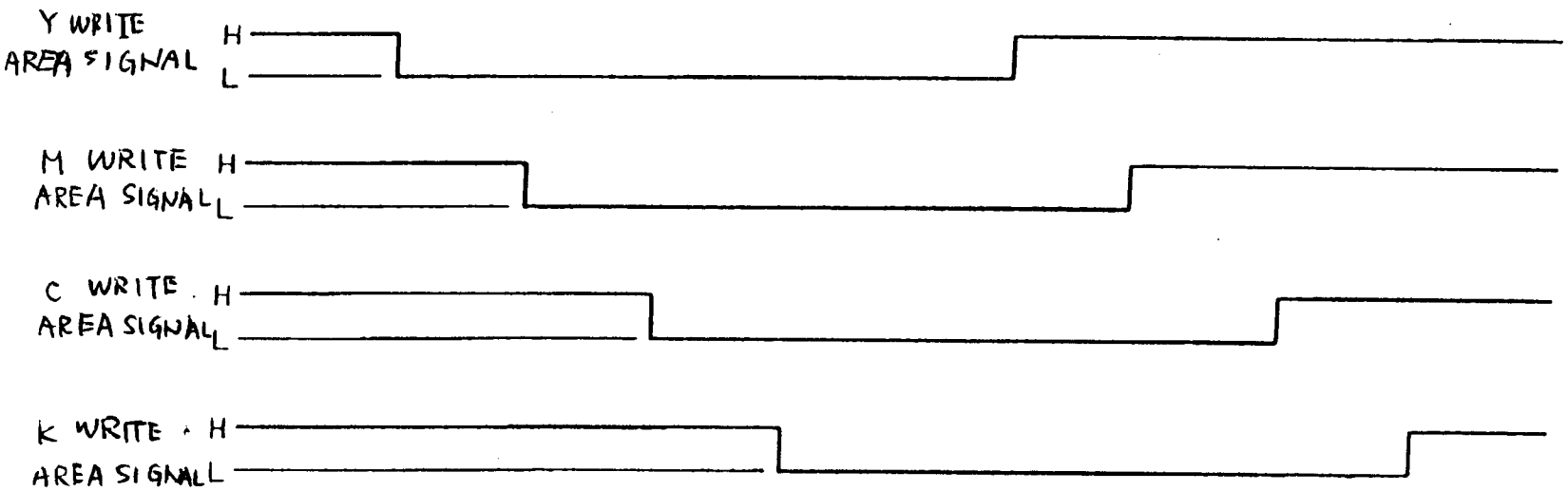
FIG. 3 is a timing chart which shows the timings of write area signals for the alignment marks and the density adjustment marks for respective colors in a sub-scan direction.
Figure 4:
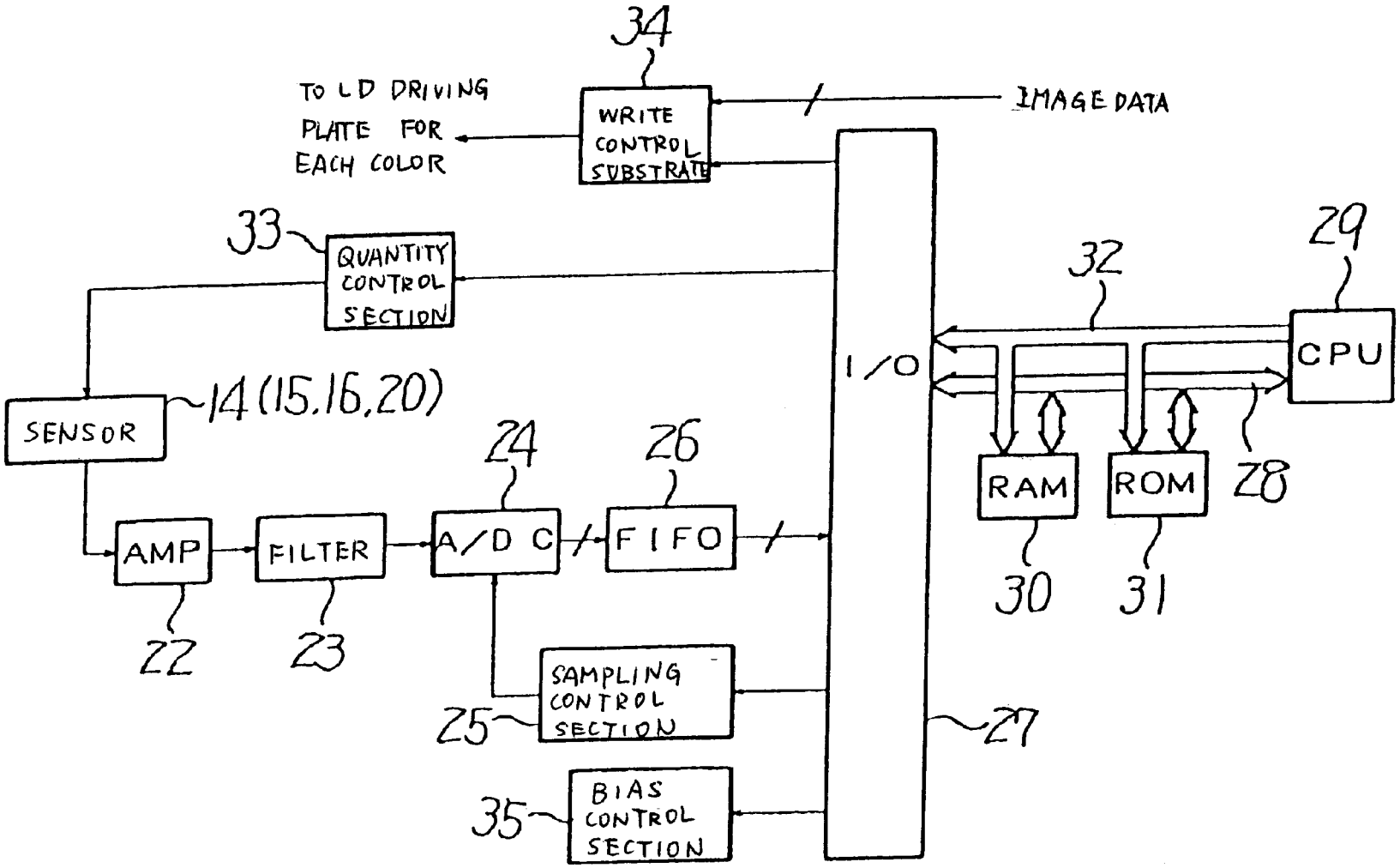
FIG. 4 is a block diagram which shows the electrical hardware configuration of the color image formation apparatus.

A first embodiment according to the present invention will be explained hereinafter with reference to FIGS. 1 to 4. The basic configuration of the color image formation apparatus in the first embodiment is the same as that of the conventional color image formation apparatus explained with reference to FIGS. 7 to 10. Therefore, the overall configuration of this color image formation apparatus will be explained with reference to FIGS. 7 and 8 as well as FIGS. 1 to 4. In addition, the same constituent elements as those in FIGS. 7 to 10 are denoted by the same reference symbols as shown in FIGS. 7 to 10, respectively and will not be explained herein (which applies to the second embodiment). FIG. 1 is an explanatory view which shows the state of the arrangement of alignment sensors and a density adjustment sensor. FIG. 2 is an explanatory view which shows alignment marks and density adjustment marks transferred onto a conveyor belt and alignment sensors and a density adjustment sensor which detect these marks, respectively. FIG. 3 is a timing chart which shows the timings of write area signals of the alignment marks and density adjustment marks for respective colors in a sub-scan direction. FIG. 4 is a block diagram which shows the electrical hardware configuration of the color image formation apparatus.

Figure 7:
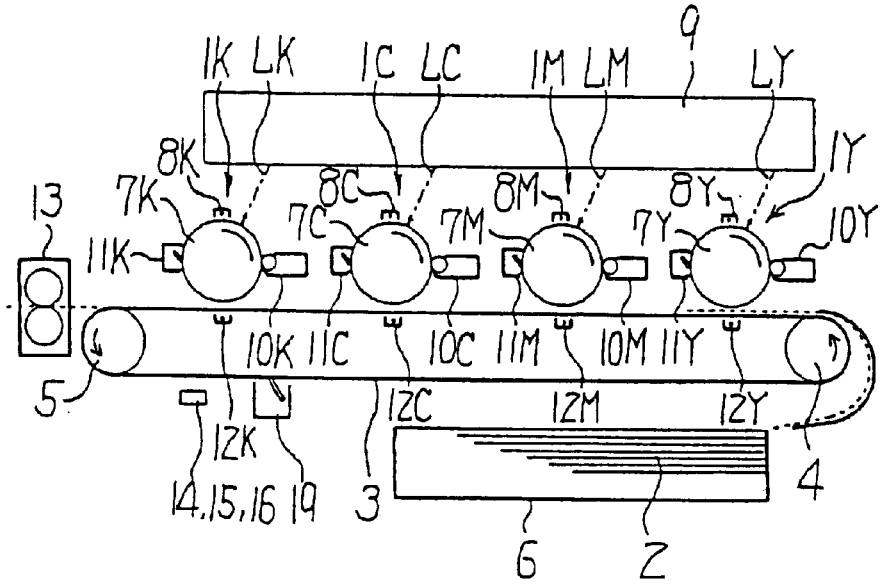
PRIOR ART FIG.7
FIG. 7 shows the overall configuration of a conventional color image formation apparatus.
Figure 8:
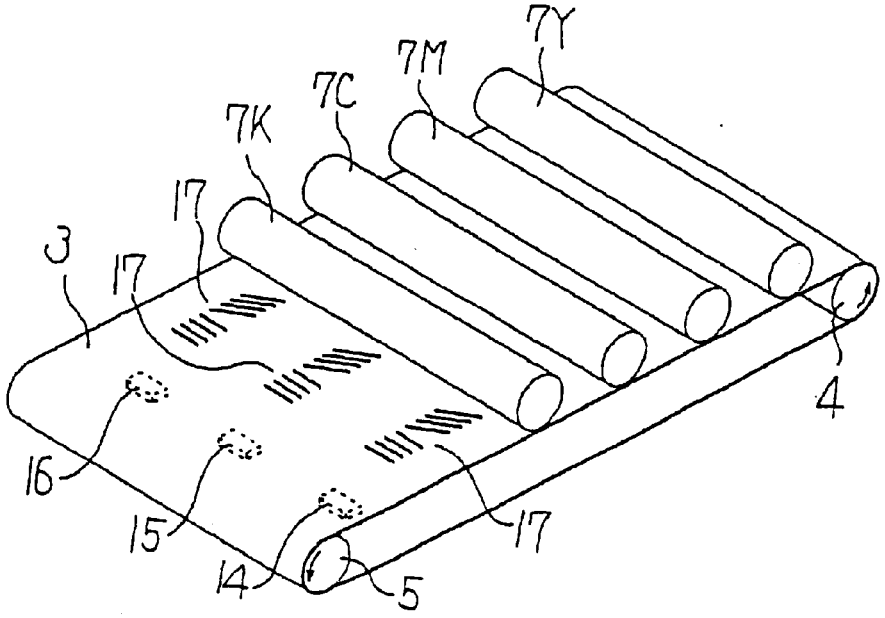
PRIOR ART FIG.8
FIG. 8 is a perspective view which shows a part of the conventional color image formation apparatus shown in FIG. 7.
Figure 9:
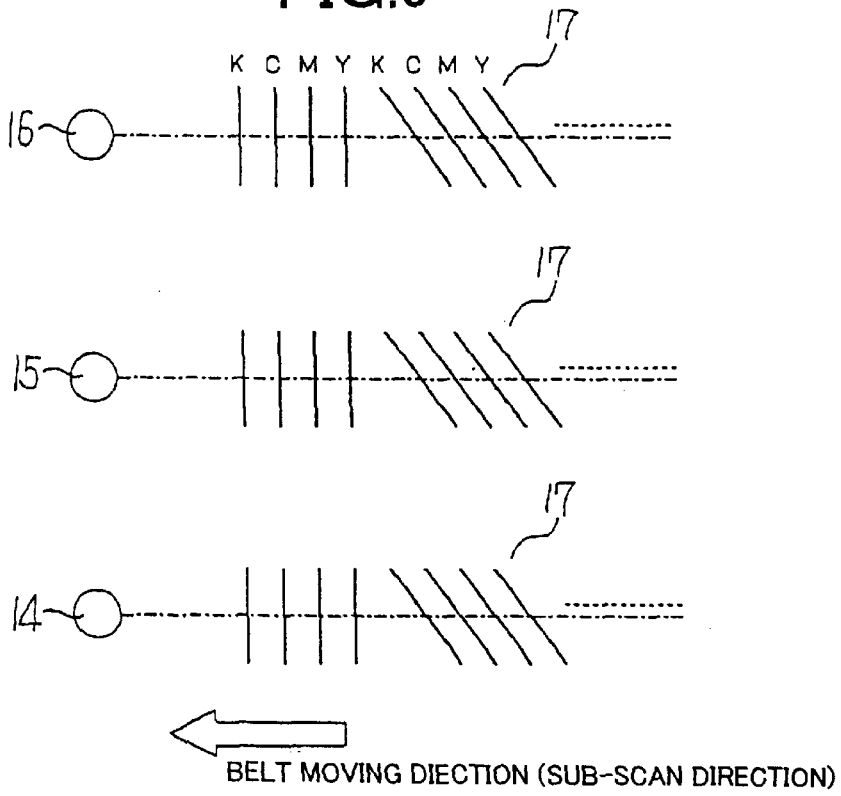
PRIOR ART FIG.9
FIG. 9 shows alignment marks transferred onto a conveyor belt and sensors which detects the mark, respectively.
Figure 10:
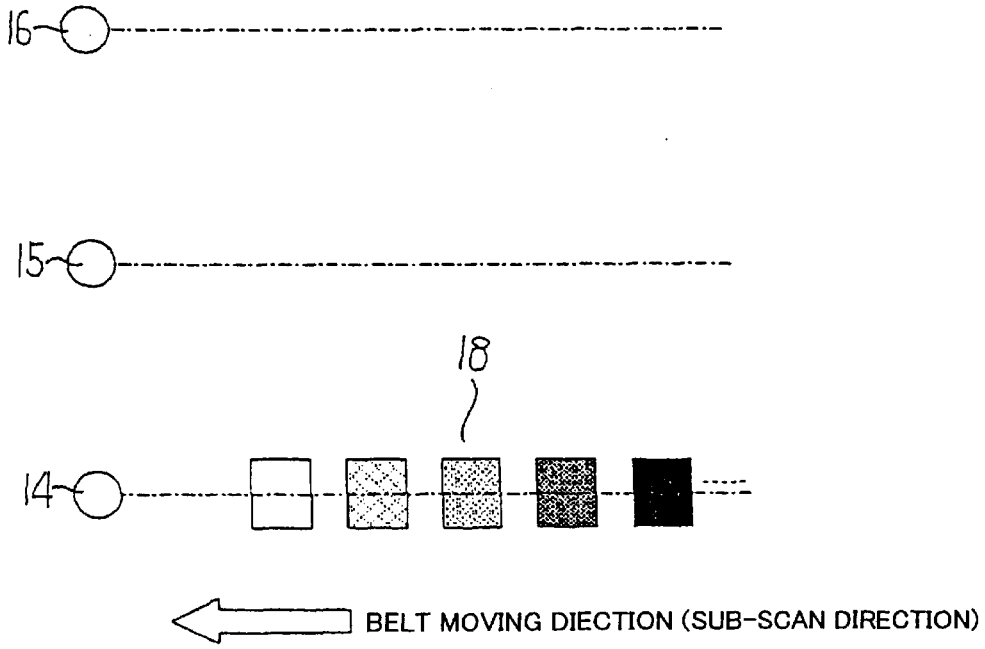
FIG.10 PRIOR ART
FIG. 10 shows density adjustment marks transferred onto the conveyor belt and a sensor which detects the marks.

As explained in FIG. 7, this color image formation apparatus has three alignment sensors 14, 15 and 16 and a density adjustment mark 20 arranged in a direction (main scan direction) orthogonal to the moving direction (sub-scan direction) of a conveyor belt 3, which is an endless belt, to face the front surface of the conveyor belt below the conveyor belt 3 and near a driven roller 5. The alignment sensors 14, 15 and 16 and the density adjustment sensor 20 are attached onto one substrate 21. The alignment sensors 14, 15 and 16 are arranged equidistantly and the density adjustment sensor 20 is arranged between the alignment sensors 14 and 15 and the detection area of the density adjustment sensor 20 does not overlap with those of the alignment sensors 14 and 15 in the direction orthogonal to the moving direction of the conveyor belt 3.

The electrical hardware configuration of the color image formation apparatus and the function thereof will be explained with reference to FIG. 4. A signal obtained from the alignment sensor 14 is amplified by an AMP 22, the frequency components of which equal to or higher than frequencies required by a filter 23 are cut off, and the resultant signal is converted from analog data to digital data by an A/D converter 24. Data sampling is controlled by a sampling control section 25. In this embodiment, a sampling rate is 20 KHz. Pieces of sampled data are sequentially stored in a FIFO memory 26. While the signal obtained from one alignment sensor 14 is explained herein, signals obtained from the other alignment sensors 15 and 16 and the density adjustment sensor 20 are similarly processed.

After all the alignment marks 17 are detected, the pieces of data stored in the FIFO memory 26 are loaded to a CPU 29 and a RAM 30 by a data bus 28 through an I/O port 27 and subjected to an arithmetic operation for calculating various slippages. As a processing based on a signal from the density adjustment sensor 20, an arithmetic operation for density adjustment is performed.

A ROM 31 stores programs for the arithmetic operations for the slippages and the density adjustment and various other programs. Further, an address bus 32 designates the address of the ROM, the address of the RAM and various input/output devices.

The CPU 29 monitors detection signals from the sensor 14 (15, 16 or 20) at an appropriate timing. A light emission quantity control section 33 controls a light emission amount so as to ensure that the sensor 14 (15, 16 or 20) can detect the signals even if a deterioration in the light emitting section of the sensor 14 (15, 16 or 20) or the like occurs and to keep the levels of light receiving signals from the sensor 14 (15, 16) constant.

Further, the CPU 29 includes a unit which sets timings for starting the formation of the alignment marks 17 and the density adjustment marks 18 to a write control substrate 34. Namely, the unit sets timing so that the alignment marks 17 and the density adjustment marks 18 transferred onto the transfer belt 3 overlap with one another in the direction (sub-scan direction) orthogonal to the moving direction of the conveyor belt 3 as shown in FIG. 2.

Furthermore, the CPU 29 make settings to the write control substrate 34 so as to change main and sub resists based on correction quantities obtained from the detected results of the alignment marks 17 and to change frequencies based on scaling errors. The write control substrate 34 includes devices each of which can set an output frequency quite minutely, e.g., clock generators each using a VCO (voltage controlled oscillator), for respective colors including a standard color.

The CPU 29 also sets a laser exposure power to the write control substrate 34 and sets a development bias based on image density conditions obtained from the detected results of the density adjustment sensor 20 and a charge bias to a bias control section 35 through the I/O port 27.

With this configuration, this color image formation apparatus has the alignment sensors 14, 15 and 16 and the density adjustment sensor 20 arranged in the sub-scan direction at positions at which the detection areas of the sensors 14, 15, 16 and 20 do not overlap with one another in the direction orthogonal to the moving direction of the conveyor belt 3. It is, therefore, possible to overlap the alignment marks 17 and the density adjustment marks 18 transferred onto the conveyor belt 3 with one another in the direction orthogonal to the moving direction of the conveyor belt 3 and to detect the alignment marks 17 by the alignment sensors 14, 15 and 16 and the density adjustment marks 18 by the density adjustment sensor 20 in parallel, as shown in FIG. 2.

FIG. 3 shows the timings of write area signals for the alignment marks 17 and the density adjustment marks 18 for the respective colors in the sub-scan direction. Write becomes effective at L level for the respective colors and the alignment marks 17 and the density adjustment marks 18 are formed and transferred in the respective effective periods. It is noted, however, that this timing control is exercised on the assumption that the density adjustment marks 18 are formed according to the gradation of the respective colors for the density adjustment by changing a laser power or lightening duty (3:0).

Therefore, the alignment marks 17 and the density adjustment marks 18 can be detected in parallel. It is thereby possible to reduce time required to complete aligning the images of the respective colors based on the detected results of the alignment marks 17 and adjusting the densities of the images of the respective colors based on the detected results of the density adjustment marks 18, to reduce time to make a user wait until the alignment of the images and the density adjustment of the images are finished, and to enhance work efficiency for image formation.

In this color image formation apparatus, the alignment sensors 14, 15 and 16 and the density adjustment sensor 20 are arranged on one substrate 21. It is, therefore, possible to share the substrate 21 among these sensors 14, 15, 16 and 20, to deal with the sensors 14, 15, 16 and 20 as one component, to facilitate managing components related to the sensors 14, 15, 16 and 20 and to reduce cost related to the sensors 14, 15, 16 and 20.

In the first embodiment, the conveyor belt 3 which attaches and conveys the sheets 2 has been explained as an example of the endless belt. Alternatively, an intermediate transfer sensor may be used, as the endless belt, to transfer alignment marks and density adjustment marks onto an intermediate transfer belt and to detect these marks.

Figure 5:
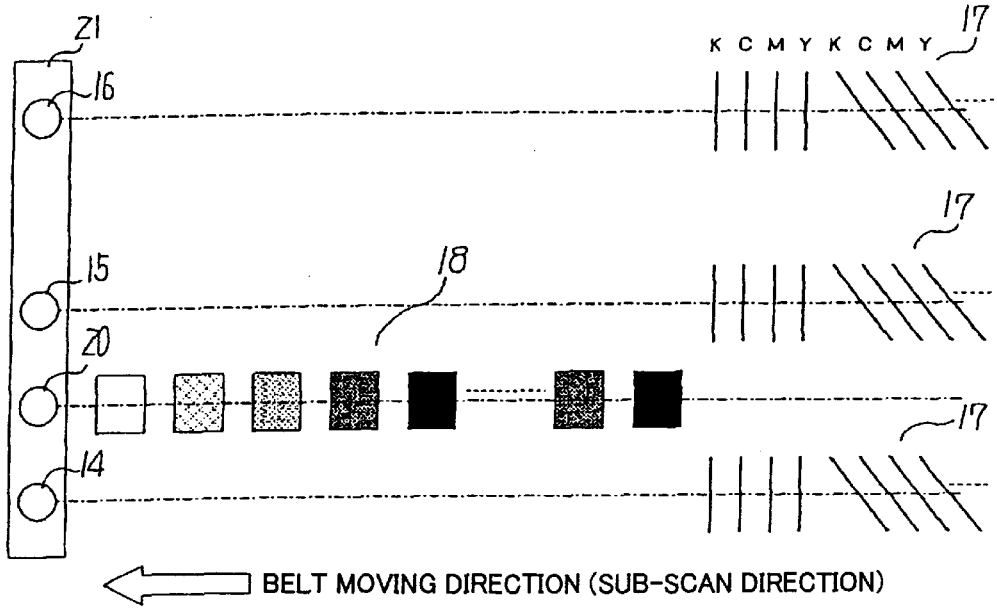
FIG. 5 shows alignment mark and density adjustment marks transferred onto a conveyor belt, alignment sensors and a density adjustment sensor which detect the respective marks in a color image formation apparatus in a second embodiment according to the present invention.

A second embodiment according to the present invention will next be explained with reference to FIGS. 5 and 6. The basic configuration of a color image formation apparatus in the second embodiment is the same as that of the color image formation apparatus in the first embodiment except for the following respect. As shown in FIG. 5, density adjustment marks 18 and alignment marks 17 transferred onto a conveyor belt 3 do not overlap with one another in the direction orthogonal to the moving direction of the conveyor belt 3. It is noted that the transfer of the alignment marks 17 onto the conveyor belt 3 is started before the cleaning of the density adjustment marks 18 transferred onto the conveyor belt 3 by a belt cleaner 19 is finished. Timings for forming the alignment marks 17 and the density adjustment marks 18 are determined by making settings to a write control substrate 34 by a CPU 29 based on programs.

To adjust image density, there is known a method for gradually changing the development bias of the density adjustment marks 18 according to the gradation of the respective colors. If this method is employed for the color image formation apparatus constituted as explained above and the alignment marks 17 and the density adjustment marks 2 are formed simultaneously as shown in FIG. 2, then densities of the alignment marks 17 also change according to a change in the development bias, with the result that the alignment sensors 14, 15 and 16 sometimes erroneously detect the marks. To prevent this malfunction, the density adjustment marks 18 are formed first and the alignment marks 17 are then formed so as not to overlap formation timings with one another as shown in FIG. 5. It is thereby possible to stably form the alignment marks 17 with a fixed development bias.

In forming the density adjustment marks 18 and the alignment marks 17, the transfer of the alignment marks 17 onto the conveyor belt 3 is started before the cleaning of the density adjustment marks 18 transferred onto the conveyor belt 3 by the belt cleaner 19 is finished. It is, therefore, possible to reduce time required until the density adjustment of images of the respective colors performed based on the detected results of the density adjustment marks 18 and the alignment of the images of the respective colors performed based on the detected results of the alignment marks 17 are finished. It is thereby possible to enhance work efficiency for image formation.

Figure 6:
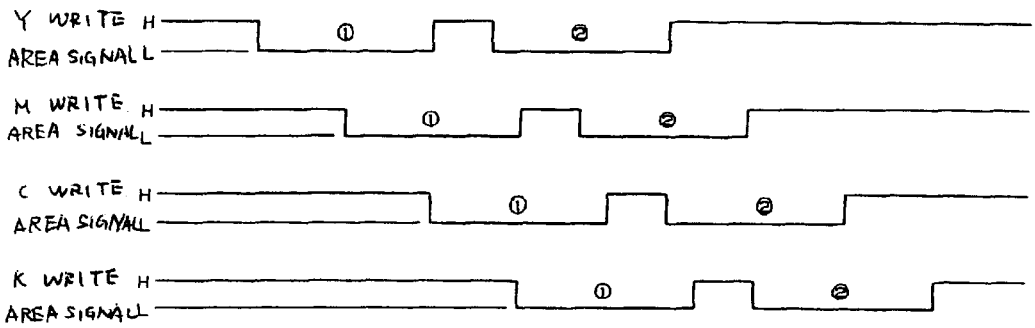
FIG. 6 is a timing chart which shows the timings of write area signals for the alignment marks and the density adjustment marks for the respective colors in a sub-scan direction.

FIG. 6 is a timing chart which shows the timings of write area signals for the density adjustment marks 18 and the alignment marks for the respective colors in the sub-scan direction. Write becomes effective at L level for the respective colors. In areas indicated by numeral 1, the density adjustment marks 18 are formed. In areas indicated by numeral 2, the alignment marks 17 are formed. Further, in an inactive period between the area 1 and the area 2, the optimal settings for the adjustment of image densities such as those for a development bias, a charge bias and a laser exposure power are made.

According to the embodiments of the present invention, in the color image formation apparatus which includes a plurality of alignment sensors which detect alignment marks for the respective colors which are formed by the image processing sections and transferred onto the endless belt, the apparatus includes the density adjustment sensor which is arranged at such a position that the detection area of the density adjustment sensor does not overlap with those of the alignment sensors in the direction orthogonal to the moving direction of the endless belt and which sensor detects the density adjustment marks transferred onto the endless belt. It is, therefore, possible to detect the alignment marks by the alignment sensors and to the density adjustment marks by the density adjustment sensor in parallel. In addition, it is possible to reduce time required until the alignment of images of respective colors performed based on the detected results for the alignment marks and the density adjustment of the images of the respective colors performed based on the detected results for the density adjustment marks are finished. It is thereby possible to enhance work efficiency for image formation.

Furthermore, according to the embodiments of the present invention, the color image formation apparatus includes the unit which controls timings for forming the alignment marks and the density adjustment marks so that the formation of either the alignment marks or the density adjustment marks is started before the cleaning of the other marks is finished in the formation of these marks. Therefore, it is possible to detect the alignment marks by the alignment sensors and the density adjustment marks by the density adjustment sensor with hardly giving time intervals between the two detection operations. As a result, it is possible to reduce time required until the alignment of images of respective colors performed based on the detected results for the alignment marks and the density adjustment of the images of the respective colors performed based on the detected results for the density adjustment marks are finished. It is thereby possible to enhance work efficiency for image formation.

Moreover, according to the first embodiment of the present invention, the alignment marks and the density adjustment marks overlap with one another in the direction orthogonal to the moving direction of the endless belt. It is, therefore, possible to detect the alignment marks by the alignment sensors and the density adjustment marks by the density adjustment sensor in parallel. In addition, it is possible to reduce time required until the alignment of images of respective colors performed based on the detected results for the alignment marks and the density adjustment of the images of the respective colors performed based on the detected results for the density adjustment marks are finished. It is thereby possible to enhance work efficiency for image formation.

Furthermore, according to the second embodiment of the present invention, the alignment marks and the density adjustment marks do not overlap with one another in the direction orthogonal to the moving direction of the endless belt. Therefore, if the density adjustment marks are formed by gradually changing the development bias, it is possible to stably form the alignment marks without causing a change in the densities of the alignment marks by a change in the development bias by preventing the density adjustment marks and the alignment marks from overlapping with one another. In this case, the formation of either the alignment marks or the density adjustment marks is started before the cleaning of the other marks is finished. It is, therefore, possible to reduce time required until the alignment of images of respective colors performed based on the detected results for the alignment marks and the density adjustment of the images of the respective colors performed based on the detected results for the density adjustment marks are finished. It is thereby possible to enhance work efficiency for image formation.

According to the embodiments of the present invention, the alignment marks and the density adjustment marks are arranged on one substrate. Therefore, the substrate is shared among the alignment sensors and the density adjustment sensor, making it possible to facilitate managing the components related to the sensors and to reduce the cost of the components related to the sensors.

The present document incorporates by reference the entire contents of Japanese priority document, 2001-279354 filed in Japan on Sep. 14, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A color image formation apparatus comprising:

an endless belt which is driven to rotate;

a plurality of image processing sections arranged along a moving direction of the endless belt and which form images of different colors, respectively;

a plurality of alignment sensors arranged in a direction orthogonal to the moving direction of the endless belt and each of which detects an alignment mark for each color formed by each of the image processing sections and transferred onto the endless belt; and a density adjustment sensor arranged at a position at which a detection area of the density adjustment sensor does not overlap with detection areas of the alignment sensors in the direction orthogonal to the moving direction of the endless belt, and which detects a density adjustment mark transferred onto the endless belt, wherein densities of the images formed by the image processing sections are adjusted corresponding to a detected result of the density adjustment sensor, and wherein a distance between an end of density marks and a beginning of alignment marks is less than a distance between a cleanina unit and the alignment and density adjustment sensors.

2. The color image formation apparatus according to claim 1, further comprising a unit which controls timings for forming the alignment marks and the density adjustment marks so that formation of one of the alignment marks and density adjustment marks is started before cleaning of the other marks is finished in forming the alignment marks and the density adjustment marks.

3. The color image formation apparatus according to claim 1, wherein the alignment marks and the density adjustment marks overlap with each other in the moving direction of the endless belt.

4. The color image formation apparatus according to claim 1, wherein the alignment marks and the density adjustment marks do not overlap with each other in the moving direction of the endless belt.

5. The color image formation apparatus according to claim 1, wherein the alignment sensors and the density adjustment sensor are arranged on one substrate.

6. A color image formation method comprising:

forming images of different colors by a plurality of image processing sections, respectively which are arranged along a moving direction of an endless belt;

detecting an alignment mark for each of the colors formed by each of the image processing sections and transferred onto the endless belt, using a plurality of alignment sensors arranged in a direction orthogonal to the moving direction of the endless belt;

detecting a density adjustment mark formed by each of the image processing sections and transferred onto the endless belt, using a density adjustment sensor arranged at a position at which a detection area of the density adjustment sensor does not overlap with detection areas of the alignment sensors in the direction orthogonal to the moving direction of the endless belt; and adjusting a density of an image formed by each of the image processing sections corresponding to a detected result of the density adjustment sensor, wherein a distance between an end of density marks and a beginning of alignment marks is less than a distance between a cleaning unit and the alignment and density adjustment sensors.

7. The color image formation method according to claim 6, further comprising controlling timing for forming the alignment marks and the density adjustment marks so that formation of one of the alignment marks and the density adjustment marks is started before cleaning of the other marks is finished in forming the alignment marks and the density adjustment marks.

8. The color image formation method according to claim 6, wherein the alignment marks and the density adjustment marks overlap with each other in the moving direction of the endless belt.

9. The color image formation method according to claim 6, wherein the alignment marks and the density adjustment marks do not overlap with each other in the moving direction of the endless belt.

* * * * *